US005388562A

United States Patent [19]

Sekiguchi et al.

[11] Patent Number: 5,388,562

[45] Date of Patent: Feb. 14, 1995

[54] FUEL INJECTION CONTROL SYSTEM FOR INTERNAL COMBUSTION ENGINE

[75] Inventors: Akira Sekiguchi; Yuichi Kitano; Kazumasa Kurihara; Masahiko Shinagawa, all of Higashimatsuyama, Japan

[73] Assignee: Zexel Corporation, Tokyo, Japan

[21] Appl. No.: 54,139

[22] Filed: Apr. 30, 1993

[30] Foreign Application Priority Data

May 8, 1992 [JP] Japan ..... 4-143321

[51] Int. Cl.[6] ..... F02D 31/00

[52] U.S. Cl. ..... 123/690; 123/359

[58] Field of Search ..... 123/357, 358, 359, 479

[56] References Cited

U.S. PATENT DOCUMENTS

| | | | |
|---|---|---|---|
| 4,509,480 | 4/1985 | Kull et al. | 123/359 |
| 4,515,125 | 5/1985 | Buck et al. | 123/359 |
| 4,534,328 | 8/1985 | Fischer et al. | 123/359 |
| 4,629,907 | 12/1986 | Kosak | 307/265 |
| 4,638,781 | 1/1987 | Shiki et al. | 123/333 X |
| 4,805,576 | 2/1989 | Abe et al. | 123/479 |
| 4,823,751 | 4/1989 | Pfalzgraf et al. | 123/359 |
| 4,905,645 | 3/1990 | Bonse et al. | 123/198 D |

FOREIGN PATENT DOCUMENTS

| | | | |
|---|---|---|---|
| 194854 | 9/1986 | European Pat. Off. . | |
| 2128773 | 5/1984 | United Kingdom | 123/359 |

*Primary Examiner*—Raymond A. Nelli

*Attorney, Agent, or Firm*—Sughrue, Mion, Zinn, Macpeak and Seas

[57] ABSTRACT

In a fuel injection system for a vehicle engine, the fuel injection is controlled in a feedback mode when no abnormality occurs in the control system, and it is controlled in an open loop mode by a limp home circuit when any abnormality in the control system is detected by a watch dog timer. The vehicle may thus be slowly driven to a safe or proper place for servicing. The limp home circuit includes fuel cutoff means for interrupting the fuel supply to the engine in the open loop mode of operation when the rotational speed of the engine exceeds a predetermined value.

5 Claims, 2 Drawing Sheets

FUEL INJECTION CONTROL SYSTEM FOR INTERNAL COMBUSTION ENGINE

BACKGROUND OF THE INVENTION

1. Field of the Invention

This invention relates to a fuel injection control system for an internal combustion engine for a vehicle, etc.

2. Description of Related Art

A Fuel injection system for performing a feedback control operation for the positioning of a control sleeve using a computer has been generally known for an internal combustion engine such as a diesel engine. The control sleeve position serves to adjust a fuel injection amount from an injection pump, and it is moved by an electric servo mechanism called an "electric governor". The electric governor is controlled by the computer.

In this type of convention Fuel injection control system, the engine is stopped for safety reasons when an abnormality occurs in the computer (for example, runaway of a program, etc.), in a position detection system for the control sleeve, or in a servo system for the electric governor, etc.

In the conventional fuel injection control system as described above, safety can be sufficiently secured because the engine is stopped when an abnormality occurs, however, in practical use it is very insufficient because the engine is stopped at all times irrespective of its status once the abnormality occurs. Particularly in a case of a vehicle, the vehicle is preferably provided with a permissible minimum driving (running) function with which the vehicle can be driven to a proper place such as a turnout when an abnormality occurs. In addition, safety is required to be sufficiently provided during the vehicle running to the turnout. However, such a requirement has not been satisfied by the conventional fuel injection control system.

SUMMARY OF THE INVENTION

An object of this invention is to provide a fuel injection control system for an internal combustion engine, which is provided with a permissible minimum running function practically required to drive an engine, and which can provide sufficient safety during vehicle operation using the permissible minimum running function.

In order to attain the above object, according to this invention, a fuel injection control system having a feedback control system for conducting a feedback control on the fuel injection of an internal combustion engine using a computer, includes abnormality detection means for detecting an abnormality of the feedback control system, and limp home circuit means for conducting an open loop control of the fuel injection of the engine in place of the feedback control when an abnormality of the feedback control system is detected, thereby providing the permissible minimum driving function (the lowest permissible driving power) which is required to drive the engine. The limp home circuit means includes fuel cutoff means for intercepting the fuel supply to the engine when its rotational speed exceeds a predetermined value.

The fuel injection is controlled in a feedback mode in a normal state by the computer. When an abnormality occurs in the feedback control system such as a CPU, a sensor system for the feedback control, a servo system for adjusting the injection amount, etc., in place of the feedback control system, the limp home circuit means is selected to control the fuel injection in an open-loop mode. For example, in the case of a vehicle, through this operation, the permissible minimum driving function (power) which is required to drive the vehicle to a proper safe place can be realized. Even during the emergency driving operation for such an abnormality-occurrence case, the fuel supply is controlled to be forcedly stopped when the rotational speed of the engine exceeds a predetermined value to provide sufficient safety.

DETAILED DESCRIPTION OF THE INVENTION

Figure 1:
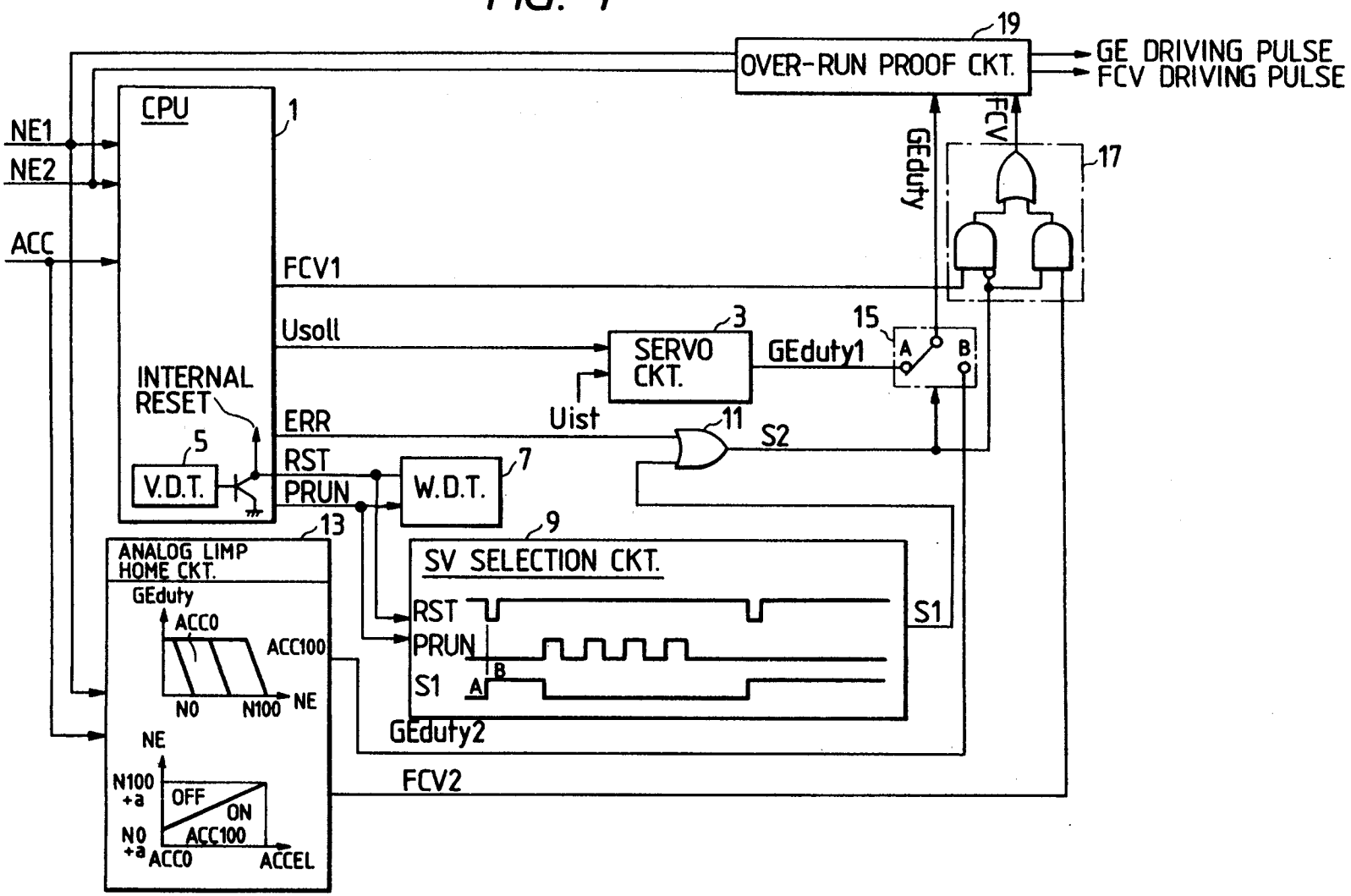
FIG. 1 is a block diagram showing the construction of an embodiment according to this invention.

A preferred embodiment according to this invention will be described hereunder with reference to the accompanying drawings, FIG. 1 is a block diagram showing the construction of an embodiment of a control system for controlling a fuel injection amount of a diesel engine for a vehicle.

In FIG. 1, a CPU 1 serves to control a fuel injection operation for an internal combustion engine when the system is in a normal state. The CPU 1 receives engine rotation pulses NE1 and NE2 from an engine (not shown) and an accelerator opening-degree signal ACC from an accelerator, and generates a first fuel cutoff valve signal FCV1 for indicating one of opening and closing states (operations) of a fuel cutoff valve with which a fuel supply to the engine is intercepted, and a sleeve target-position signal Usoll for indicating a target position of a control sleeve with which the fuel injection amount is adjusted, The CPU 1 also serves to monitor the operation status of a system for detecting the position of the control sleeve and a servo system for an electric governor, etc. (not shown), and generates an H-level error signal ERR when detecting an abnormality of these systems. In addition, the CPU 1 generates an operation pulse PRUN at a constant period when it is normally operated.

The sleeve target-position signal Usoll output from the CPU 1 is input to a servo circuit 3. The servo circuit 3 receives a sleeve actual-position signal Uist from a control sleeve position sensor (not shown), and determines the duty ratio of a governor driving pulse for driving an electric governor (not shown) on the basis of the deviation between the actual-position signal Uist and the target-position signal Usoll to generate a duty-ratio signal GE(duty) 1.

The CPU 1 is provided with a watch dog timer 5 therein, or with an external watch dog timer 7. The built-in watch dog timer 5 generates a reset signal RST when detecting an abnormality of the CPU 1, and the reset signal RST is used as an internal reset for the CPU 1 and output to the external watch dog timer. The external watch dog timer 7 receives the operation pulse PRUN from the CPU 1, and generates a reset signal RST when detecting an abnormality of the operation pulse PRUN (for example, an omission of the signal, a frequency abnormality, etc.). The reset signal thus output is fed back to the CPU 1 and used as an internal reset.

The operation pulse PRUN output from the CPU 1 and the reset signal RST output from the built-in or external watch dog timer 5 or 7 are also input to a switch selection circuit 9. The switch selection circuit 9 comprises a flip-flop which is reset at the trailing edge of the reset signal RST, and generates a first select signal S1 of H-level during a period from a set time to a reset time.

That is, the switch selection circuit 9 continues to generate the first select signal S1 from an abnormality-occurring time of the CPU 1 until a normality-restored time of the CPU 1.

The error signal ERR output from the CPU 1 when the control sleeve position detection system or the governor servo system is in the abnormal state, and the first select signal S1 output from the switch selection circuit 9 when the CPU 1 is in the abnormal state, are input to an OR gate 11 to generate a second select signal S2 at its output.

That is, when any one of the control sleeve position detection system, the governor servo system and the CPU 1 is in an abnormal state (hereinafter referred to as "system abnormal state"), the H-level second select signal S2 is generated.

An analog limp home circuit 13 serves to control the fuel injection amount in the system abnormal state. It receives the engine rotation pulse NE1 and the accelerator opening-degree signal ACC and determines the duty ratio of the electric governor driving pulse on the basis of these signals to generate a second duty-ratio signal GE(duty)2. The limp home circuit 13 determines or selects one of the opening and closing states (operations) of the engine fuel cutoff valve on the basis of the engine rotation pulse NE1 and the accelerator opening-degree signal ACC to generate a second fuel cutoff valve signal FCV2. The duty ratio and the method of determining (selecting) one of the opening and closing states (operations) of the fuel cutoff valve in the limp home circuit will be described later.

The first duty-ratio signal GE(duty)1 output frown the servo circuit 3 and the second duty-ratio signal GE(duty)2 output from the limp home circuit 13 are input to a first change-over switch 15.

The first fuel cutoff valve signal FCV1 output from the CPU 1 and the second fuel cutoff valve signal FCV2 output from the limp home circuit 13 are input to a second change-over switch 17. The first and second change-over switches 15 and 17 are controlled with the second select signal S2 from the OR gate 11 in such a manner that the signals GE(duty)1 and FCV1 supplied from the CPU 1 side are selected when the select signal S2 is at a low level (that is, the system is in the normal state), and the signals GE(duty)2 and FCV2 supplied from the limp house circuit 13 are selected when the select signal S2 is at a high level (that is, the system is in an abnormal state).

The signals thus selected by the change-over switches 15 and 17 are input to an over-run proof circuit 19 as the duty-ratio signal GE(duty) and the fuel cutoff valve signal FCV, respectively.

The over-run proof circuit 19 serves to monitor the engine rotation pulses NE1 and NE2, and when the frequency of these pulses is lower than a predetermined value, it generates an electric governor driving pulse and a fuel cutoff valve driving pulse which correspond to the duty-ratio signal GE(duty) and the fuel cutoff valve signal FCV, respectively. On the other hand, when the frequency of the rotation pulses NE1 and NE2 exceeds the predetermined value, the over-run proof circuit 19 stops the supply of the electric governor driving pulse and the fuel cutoff valve driving pulse in order to prevent the over-running of the engine.

As described above, the CPU 1 serves to directly control the fuel injection amount in a feedback mode when the system is in a normal state, and the analog limp home circuit 13 is selected and serves to control the fuel injection amount in an open-loop mode when the system is in an abnormal state.

Figure 2:
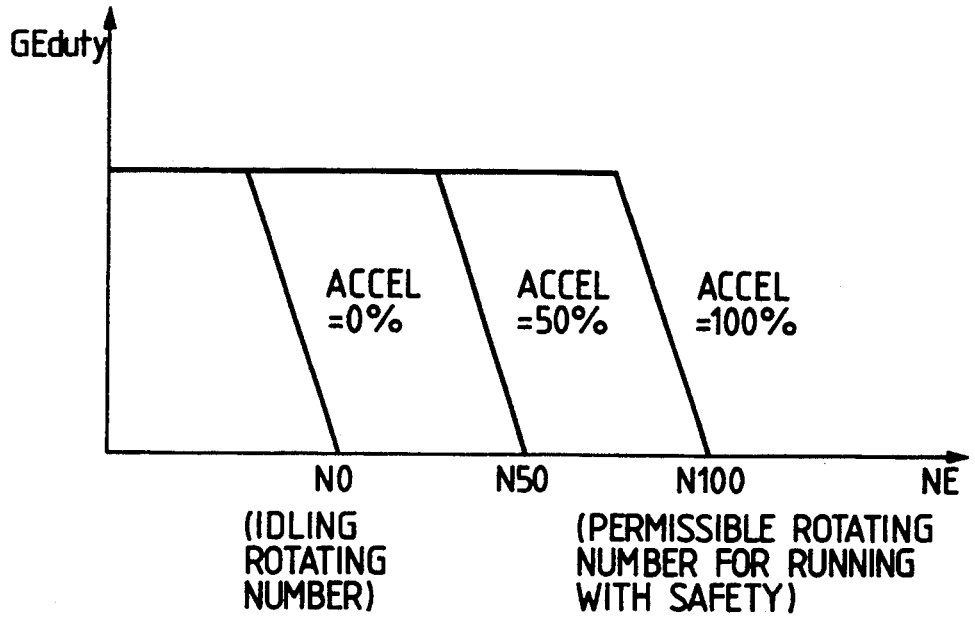
FIG. 2 is a diagram showing a duty ratio determining method for an electric governor driving pulse in a limp home circuit of the embodiment as shown in FIG. 1.

FIG. 2 is a diagram showing a determination method for the duty ratio of the electric governor driving pulse in the limp home circuit 13.

As is apparent from FIG. 2, the duty ratio GE(duty) is so determined that the engine rotation number NE does not exceed the maximum rotation number which is determined in accordance with the accelerator opening-degree ACCEL at this time. Here, the maximum rotation number in accordance with the accelerator opening-degree ACCEL corresponds to an intercept value of a graph of the GE(duty) for each accelerator opening-degree ACCEL on the rotating number (NE) axis. For example, the maximum rotation number for an accelerator opening-degree ACCEL=0% corresponds to an idling rotation number NO, and the maximum rotation number for an accelerator opening-degree ACCEL=100% corresponds to a predetermined engine rotation number N100 at which a vehicle can run with safety. The maximum rotation number for an intermediate accelerator opening-degree ACCEL between 0% and 100% corresponds to an intermediate value between NO and N100, which is a value determined in proportion to the accelerator opening degree.

Through the control of the duty ratio as described above, a permissible minimum running function required for driving the vehicle to a safe or service place can be provided.

Figure 3:
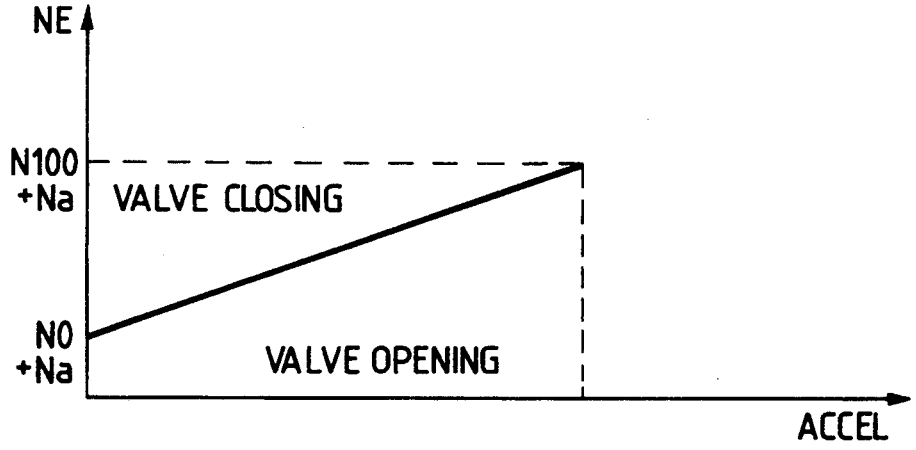
FIG. 3 is a diagram showing a determination method for opening and closing a fuel cutoff valve in the limp home circuit of the embodiment as shown in FIG. 1.

FIG. 3 is a diagram showing a method of determining (selecting) one of the opening and closing states (operations) of the limp home circuit which is a main feature of this embodiment.

As is apparent From FIG. 3, a threshold level (as indicated by a solid line) is calculated by summing a predetermined permissible excess amount Na and a maximum rotation number corresponding to each accelerator opening-degree ACCEL which is determined in. FIG. 2, and the opening state of the valve is selected when the engine rotation number NE is lower than the threshold level, while the closing state of the valve is selected when the engine rotation number NE is higher than the threshold level.

That is, when the engine rotation number NE is higher than the maximum rotation number corresponding to each accelerator opening-degree ACCEL by the permissible excess amount Na, the fuel cutoff valve is closed to intercept the fuel supply to the engine. Therefore, the engine rotation number can be prevented from being excessively increased during the vehicle abnormality running, so that safety can be sufficiently secured.

What is claimed is

1. A fuel injection control system having a computer implemented feedback control for the fuel injection of an internal combustion engine of a vehicle, comprising:

a) abnormality detection means for detecting an abnormality of the feedback control; and b) limp home circuit means for conducting an open loop control of the fuel injection of the engine in place of the feedback control when an abnormality of the feedback control is detected by said abnormality detection means to enable a reduced speed operation of the vehicle, said limp home circuit means including fuel cutoff means for interrupting a fuel supply to the internal combustion engine when a rotational speed thereof exceeds a predetermined value which varies as a function of an accelerator pedal depression.

2. The fuel injection control system as claimed in claim 1, wherein said limp home circuit means comprises a limp home circuit for determining one of an opening and a closing operation of said fuel cutoff means on the basis of a signal representing a rotation number of the internal combustion engine and a signal representing an accelerator opening degree, and outputting a signal representing the determined operation to said fuel cutoff means.

3. The fuel injection control system as claimed in claim 1, further including switch means for switching from the feedback control to the open loop control by said limp home circuit means when an abnormality of said feedback control is detected by said abnormality detection means.

4. The fuel injection control system as claimed in claim 1, wherein said abnormality detection means comprises a watch dog timer for generating a reset signal when an abnormality is detected.

5. A fuel injection control method for controlling a fuel injection to an internal combustion engine, comprising the steps of:

a) controlling the fuel injection in a feedback mode when a control system for implementing the fuel injection is in a normal state;

b) detecting an abnormality of the control system;

c) switching the fuel injection control from the feedback mode to an open loop mode when an abnormality of the control system is detected; and d) interrupting a fuel supply to the internal combustion engine in the open loop control mode when the rotational speed of the engine exceeds a predetermined value which varies as a function of an accelerator pedal depression.

* * * * *